US006375166B1

(12) United States Patent
Schall et al.

(10) Patent No.: US 6,375,166 B1
(45) Date of Patent: Apr. 23, 2002

(54) FENCE WHICH ELIMINATES THE NEED FOR CONVENTIONAL FASTENERS

(75) Inventors: Frederick R. Schall, Mt. Laurel, NJ (US); Peter B. Goodale, New Castle, DE (US)

(73) Assignee: Delair Group, Inc., Delair, NJ (US)

( * ) Notice: Subject to any disclaimer, the term of this patent is extended or adjusted under 35 U.S.C. 154(b) by 0 days.

(21) Appl. No.: 09/535,124

(22) Filed: Mar. 24, 2000

(51) Int. Cl.[7] ..... E04H 17/14
(52) U.S. Cl. ..... 256/65; 256/21; 256/59
(58) Field of Search ..... 256/21, 22, 59, 256/65, 68, 66

(56) References Cited

U.S. PATENT DOCUMENTS 5,454,548 A * 10/1995 Moore ..... 256/65
5,660,378 A 8/1997 Schall
6,173,944 B1 * 1/2001 McCarthy ..... 256/19
6,299,142 B1 * 10/2001 Chaney et al. ..... 256/65

FOREIGN PATENT DOCUMENTS

GB 2058168 A * 4/1981

* cited by examiner

*Primary Examiner*—Lynne H. Browne
*Assistant Examiner*—Aaron Dunwoody
(74) *Attorney, Agent, or Firm*—Volpe and Koenig PC

(57) ABSTRACT

A fenced assembled from a plurality of pickets and at least one insert and at least one rail. The insert is laid across the pickets which are preferably arranged in spaced-parallel fashion. A piercing tool pierces through the insert and an associated picket, causing at least one tab of the insert, formed by the piercing action, to extend into the picket. The channel-shaped rail slides over the insert so that an integrated hook rib shape-fittingly moves into a gap between two integral legs provided near one end of the insert to lock the rail and insert to one another. The rail, in the locked position, substantially completely covers the insert, providing fence having an aesthetically appealing outer appearance.

14 Claims, 5 Drawing Sheets

Fig 1a
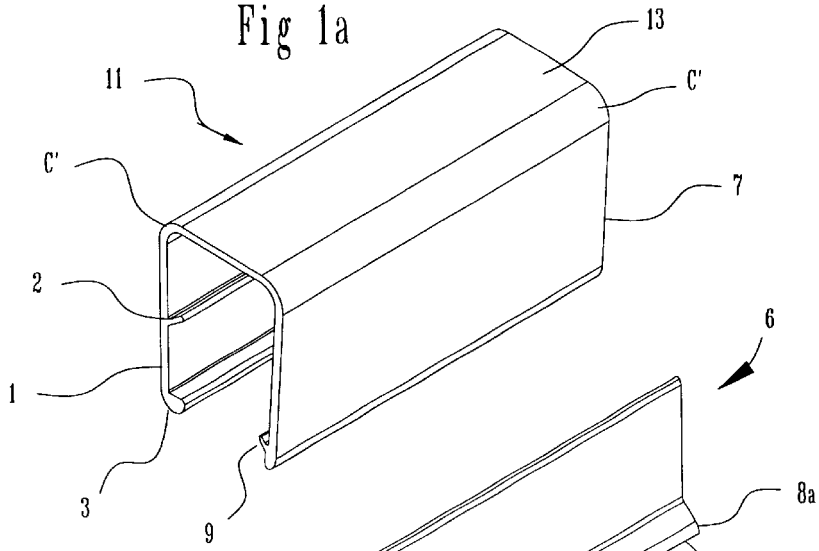
Fig 1b
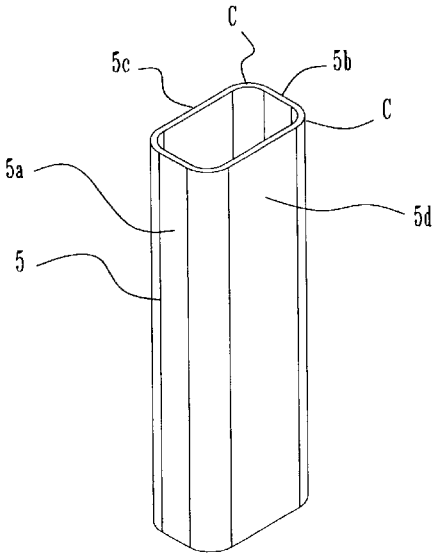
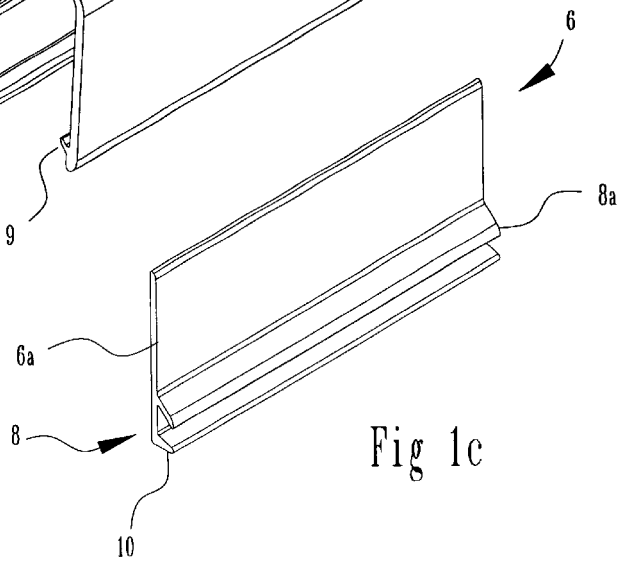
Fig 1c

FENCE WHICH ELIMINATES THE NEED FOR CONVENTIONAL FASTENERS

FIELD OF THE INVENTION

The present invention relates to a design for fences which are preferably assembled in situ and more particularly, to a novel design and method of assembly which utilizes a punching operation for joining certain components thereof.

BACKGROUND OF THE INVENTION

Fences are typically constructed employing conventional fasteners. However, conventional fasteners often distort the fastened components and further detract from the otherwise aesthetic appearance of the fence. In one technique, described in U.S. Pat. No. 5,660,378, issued Aug. 26, 1997 and assigned to the present invention, although conventional fasteners are eliminated, the pickets employed in the fence assembly require pre-punching and/or pre-drilling of openings to receive the inserts employed in the fence structure.

BRIEF DESCRIPTION OF THE INVENTION

The present invention is characterized by comprising a design and method for assembling a fence which eliminates the need for conventional fasteners and pre-punched or pre-formed holes and is comprised of only three basic elements, namely, a plurality of pickets, one or more inserts and a channel-shaped rail associated with each insert.

The pickets, in one embodiment, are each inserted through an associated one of the openings in the rail. The insert is positioned immediately beneath one side of the rail and with its flat surface engaging associated flat surfaces of the pickets. A piercing tool, such as a punch, pierces an opening into the insert and the picket associated therewith forming at least one tab which tab projects into the picket, locking the insert to each of the pickets. The rails are then pushed down over the pickets and the insert until a cooperating projection on the rail snaps into position between a pair of projections on the insert, locking the rail in place. The rail completely covers the insert providing an aesthetically pleasing, finished appearance.

The side of the rail opposite the side engaging the insert is provided with a solid, integral rib at its free end to provide rigidity over its length and a continuous internal finger which prevents the rail from rotating over the tops of the pickets in applications where the pickets do not extend through the rail.

The components making up the fence may be extruded, rolled or machined of metal, plastic or wood.

The punch is formed of a material capable of respectively puncturing and then deforming the insert and pickets so that they lock together. No mandrel is required on the interior of the pickets, but one may be used if desired, for example, in applications where the punches into the pickets are made near the ends thereof. The punch causes one or more tabs (preferably two) to be formed from the pierced insert and to protrude into the picket, preventing the picket from easily sliding vertically or horizontally in relation to the insert independently of the rail. The punch has no moving parts, but may be mounted upon a press, if desired.

The advantages of the invention reside in the fact that among others, the fence has no visible fasteners and a clean and esthetically appealing exterior finish, the fence can not be easily disassembled, providing security and the rails and pickets have a smooth continuous appearance and are distortion free which distortion may typically occur in fences having the components thereof joined by conventional fastening means.

OBJECTS OF THE INVENTION

It is therefore one object of the present invention to provide a novel fence design and method for assembling such a fence in which the only tool required for assembly is a punch.

Still another object of the present invention is to provide a novel fence design which is comprised of three basic elements, namely, pickets, a rail and an insert joined to each picket by a simple punching operation and covered by a rail to provide a neat, esthetically appealing finished appearance.

Still another object of the present invention is to provide a novel three-piece fence design of the type described hereinabove and wherein the insert member is snap-fittingly received within the rail to provide a self-locking feature while eliminating the need for conventional fasteners.

Still another object of the present invention is to provide a novel method of fence assembly that prevents rattling noise between pickets and rails which would otherwise be present due to the loosening of conventional fasteners.

BRIEF DESCRIPTION OF THE FIGURES

The above as well as other objects of the present invention will become apparent when reading the accompanying description and drawings in which:

FIGS. 1*a*, 1*b* and 1*c* are perspective views of a rail, insert and picket, which elements constitute the three basic elements of the fence design of the present invention;

DETAILED DESCRIPTION OF THE INVENTION AND PREFERRED EMBODIMENTS THEREOF

Figure 2A:
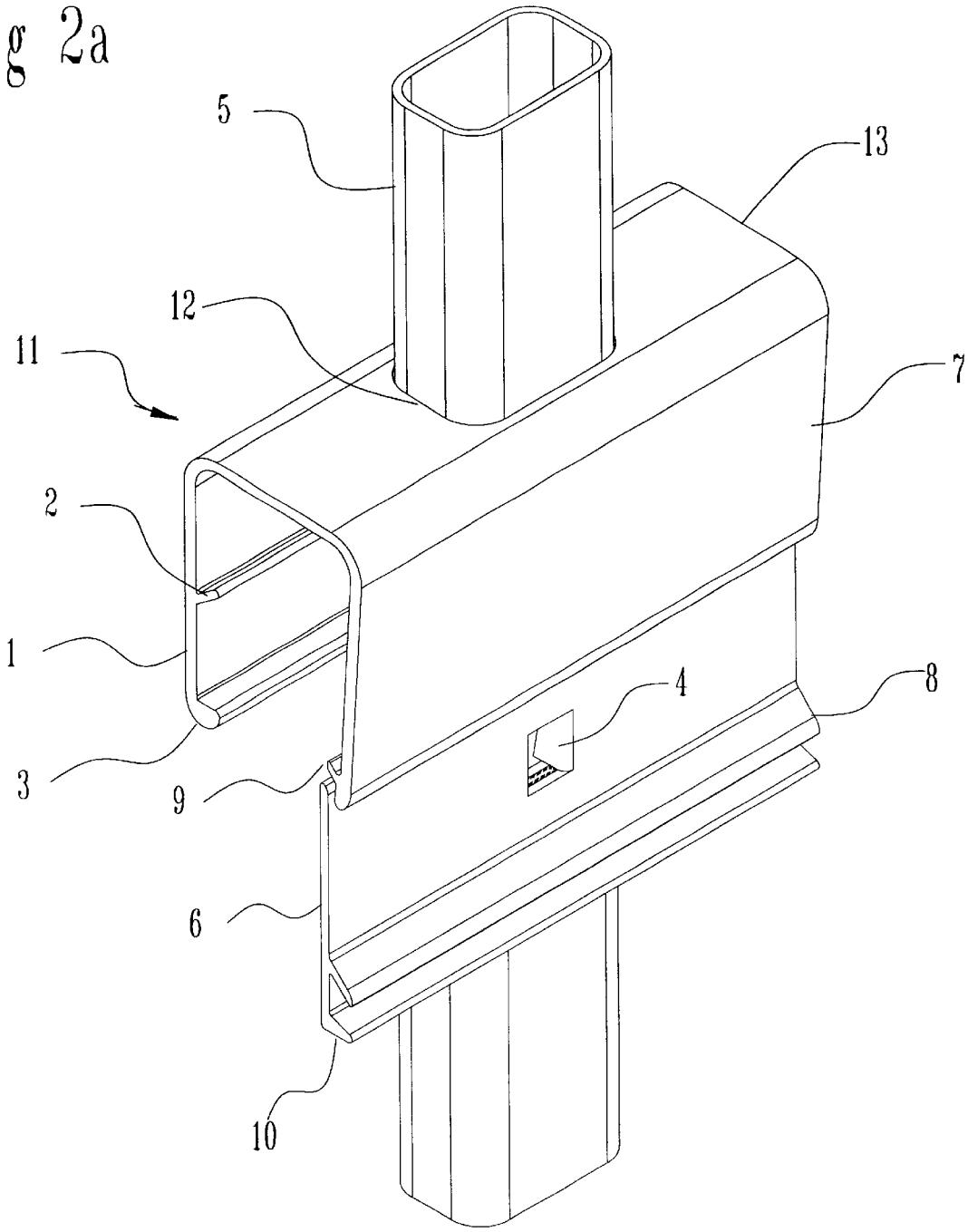
FIG. 2*a* shows the three elements of FIGS. 1*a*–1*c* in a partially assembled state.

As was pointed out hereinabove, the present invention provides a fence design which is comprised of three basic elements, namely, a picket rail 11, a picket 5 and an insert 6, respectively shown in FIGS. 1*a*, 1*b* and 1*c*.

The picket 5, in a preferred embodiment thereof, comprises a hollow, tubular-shaped member having a substantially rectangular-shaped configuration with substantially planar sidewalls 5*a* and 5*b* of lesser width and sidewalls 5*c* and 5*d* of greater width, adjacent sidewalls being joined by curved corners C.

It should be understood that the picket 5 may be of any desired length typically, depending upon the desired height of the fence to be constructed. The specific picket configuration may be rectangular, square-shaped or polygonal or even, oval or round in cross section, although it is preferred to have at least one portion of the fence provided with a flat or planar surface, but this requirement is not imperative.

The pickets 5 may be formed of a suitable plastic or metal material and are preferably, hollow members. However, if desired, solid, wooden pickets may be employed with equal success.

The insert 6 is an elongated substantially, planar sheet-like member having a main body portion 6*a* with a substantially rectangular cross-section, the height thereof being significantly greater than the thickness. The length of the insert is a function of the width of the fence section in which it is being employed.

The insert 6 has a pair of integral flanges or legs 8 and 10. Integral flange 10 extends from the bottom edge of the main body portion 6*a* and is aligned substantially at right angles thereto.

Integral projection 8 is diagonally aligned relative to main body portion 6*a* and has its free end 8*a* extending toward leg 10, forming a substantially trapezoidal-shaped, hollow region therebetween, which legs serve as a locking means as will be described in greater detail hereinbelow.

Insert 6 is preferably molded, machined, formed or extruded from a suitable metal or plastic material.

Rail 11 is a substantially channel-shaped member having a yoke portion 13 joined to a pair of integral sidewalls 1 and 7. Yoke portion 13 merges into sidewalls 1 and 7 by means of curved corners C', providing an esethically appealing external finish. However, if desired, the corner sections C', as well as the corners C, may be angled corners or chamfered.

Sidewall 7 is provided with an integral, elongated hook rib 9 which is diagonally aligned relative to sidewall 7 so that its free end points upwardly and inwardly toward yoke 13. Hook rib 9 cooperates with legs 8 and 10 of insert 6 to lock the rail 11 and insert 6 relative to one another, as will be more fully described hereinbelow.

The opposite sidewall 1 of rail 11 is provided with an integral, inwardly-directed, solid rib 3 terminating in a bead-like shape and extending along the length of the sidewall so as to provide rigidity therefore.

Figure 3:
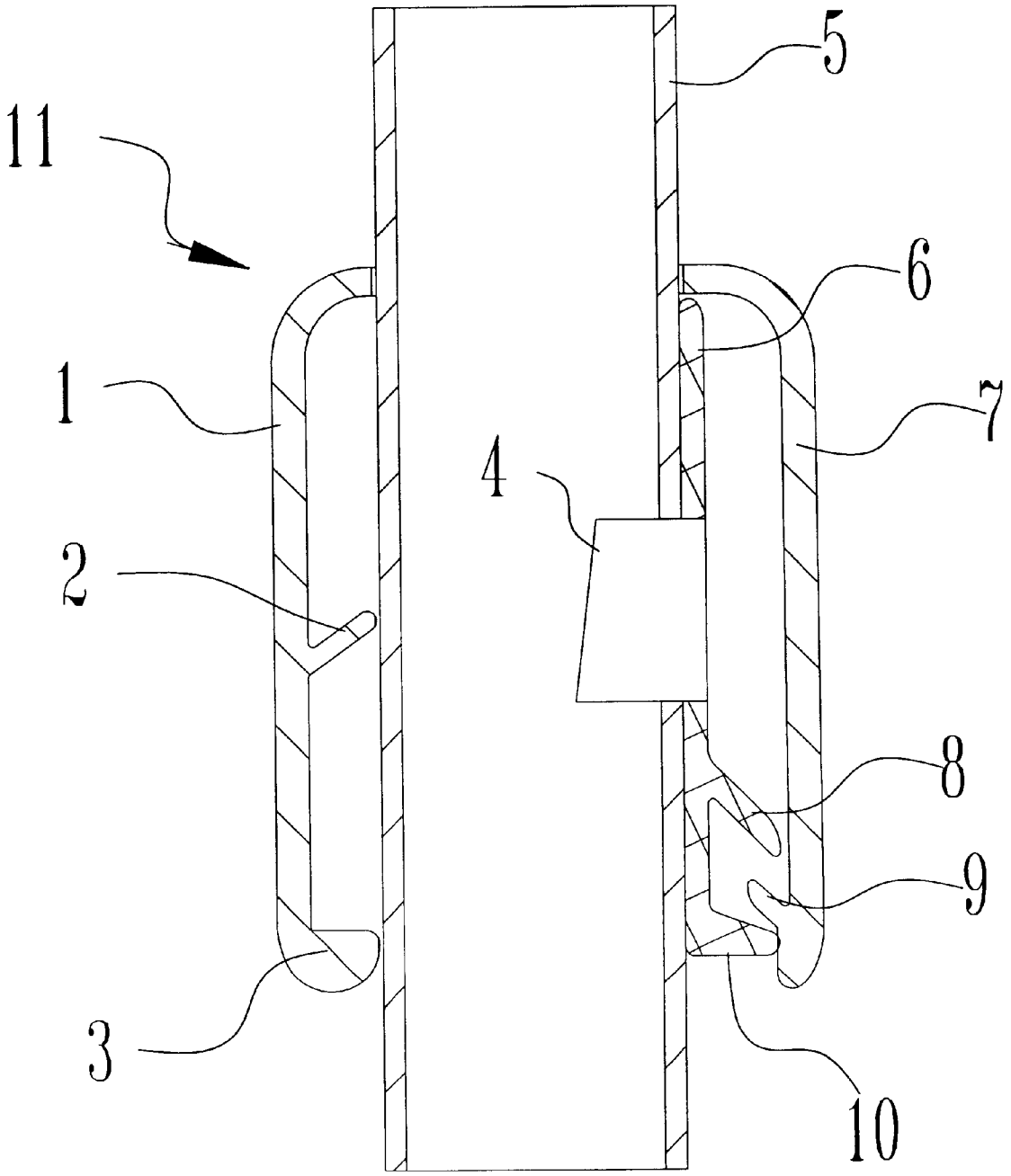
FIG. 3 is a sectional view of the fully assembled structure shown in FIG. 2*b* looking in the direction of arrows 3–3'.
Figure 4:
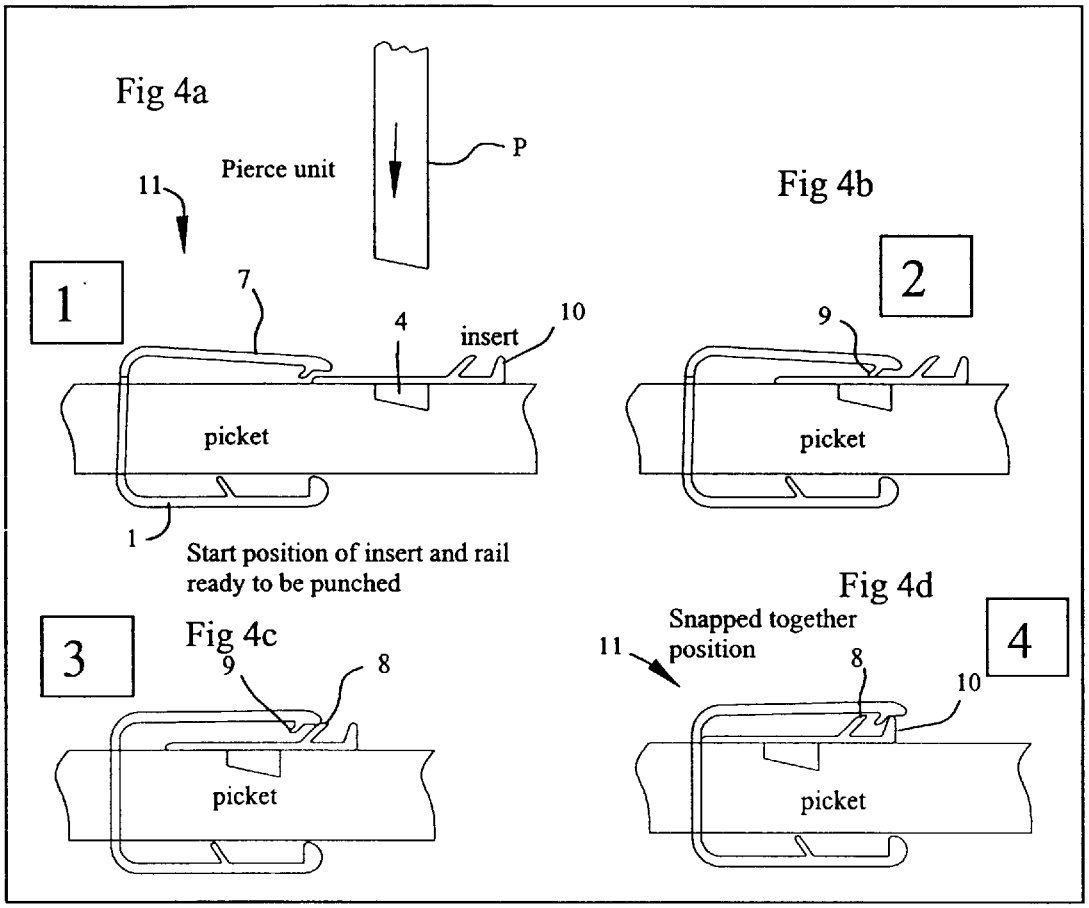
FIGS. 4*a*–4*d* are simplified end views which are useful to show the manner in which the three elements of FIGS. 1*a*–1*c* are assembled.

An integral internal finger 2 extends diagonally upwardly and to the right relative to sidewall 1 and is adapted to engage the pickets, as will be more fully described hereinbelow, in order to prevent the rail from rotating over the tops of the pickets in installations where the pickets do not extend through the rail, as shown in FIGS. 2*a* and 3.

The rail 11 is preferably either extruded or molded from a suitable metal or plastic material.

The manner in which the fence is assembled will now be described in connection with FIGS. 2*a*–4*d* and includes the following steps:

The rails 11 are preferably prepared at the factory so as to be provided with a plurality of openings 12 (see FIG. 2*b*) arranged at spaced intervals along the yoke 13, each opening having a shape preferably conforming to the cross-section of the picket 5. The openings 12 are spaced according to the desired spacing of the pickets intended to extend therethrough.

Each picket 5 is inserted through an associated opening 12. The rail 11 is preferably positioned so that it is located just above its desired final position.

Figure 2B:
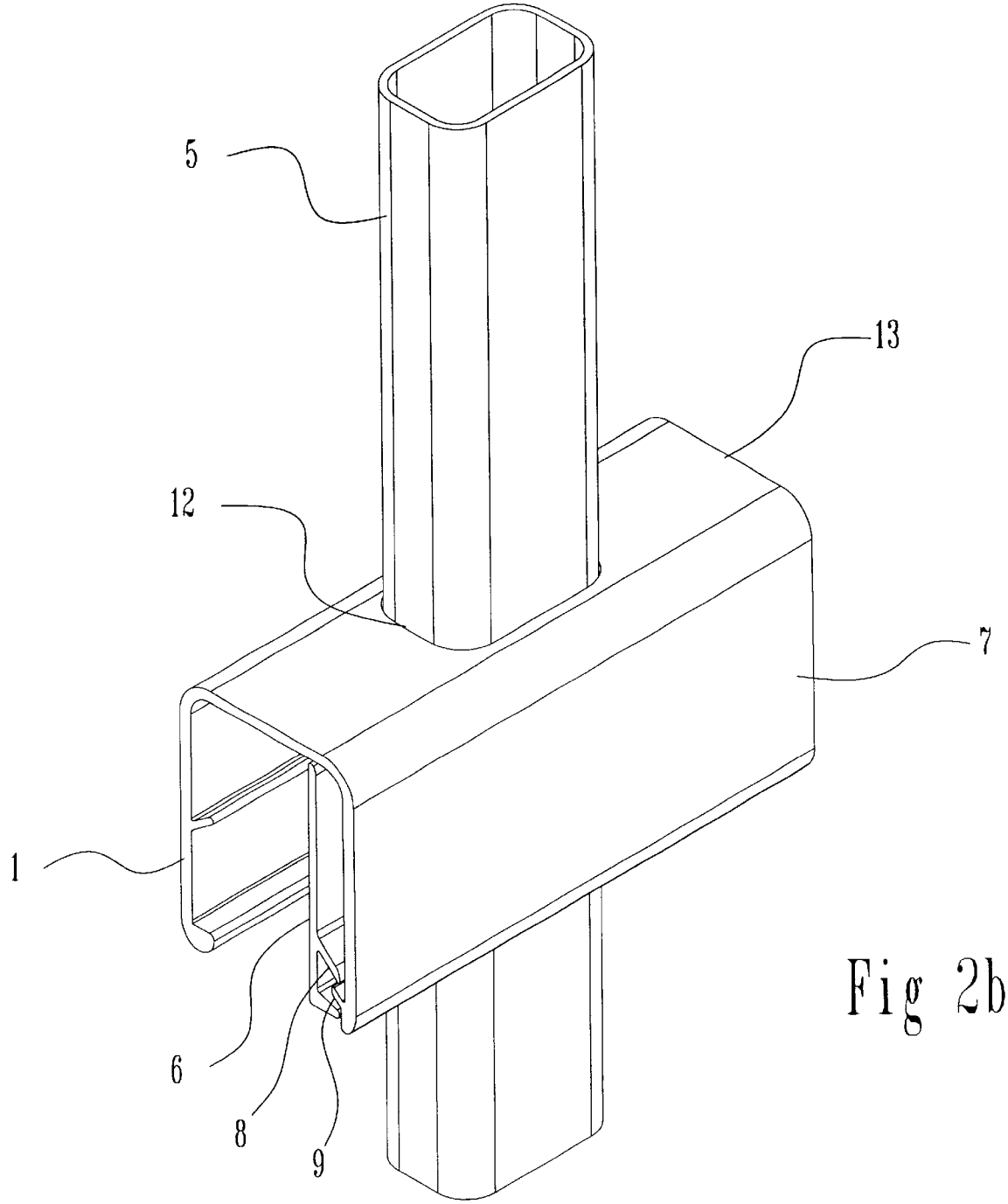
FIG. 2*b* is a perspective view showing the three elements of FIGS. 1*a*–1*c* in the fully assembled state.
Figure 5:
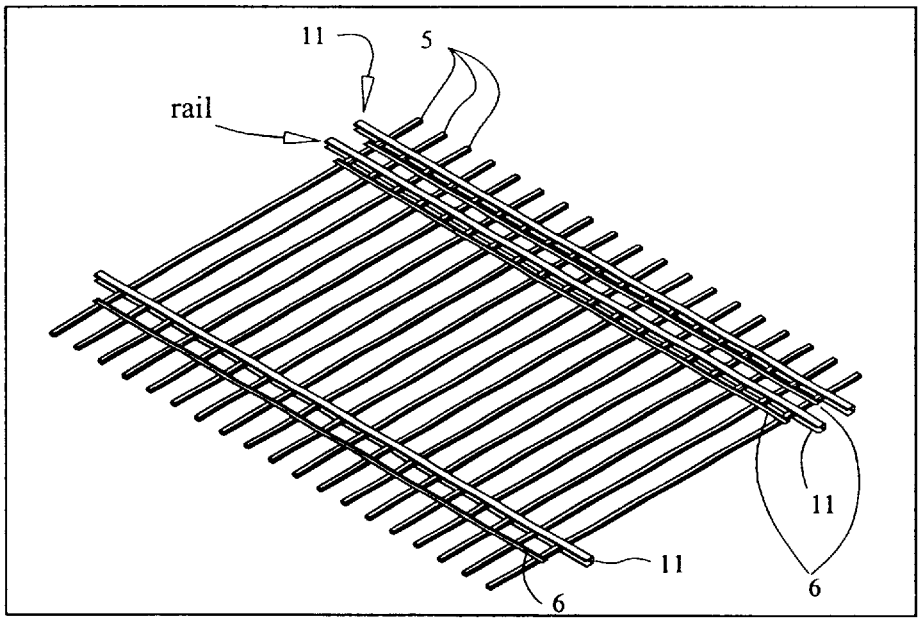
FIG. 5 is a perspective view showing a fence section embodying the principles of the present invention and shown in a stage prior to completion of the assembly.

The insert 6 is placed across the pickets 5 in the manner shown in FIGS. 2*a*, 4*a* and 5 so that the rear surface thereof rests against an engaging surface of each of the pickets 5. The insert 6 is positioned so that its lower leg 10 is substantially aligned with the position that the lower edges of the rail occupy when the rail, insert and picket members are fully assembled, as shown in FIGS. 2*b* and 3.

A piercing unit or tool, such as a punch P, is positioned in the manner shown in FIG. 4*a* so as to be aligned with the sidewall of the picket which engages the back surface of the insert. The piercing unit is then preferably abruptly moved downwardly to pierce the insert 6 and the picket 5, causing a portion of the main body 6*a* of the insert to be cut away from the main body 6*a* and urged into the interior of the associated picket, which also experiences a piercing action. The pierced portion 4 of insert 6 forms one or two tabs 4, shown in FIGS. 2*a* and 4*a*, locking the pickets in place. The insert is pierced by punch P at spaced intervals where each successive picket 5 is located, forming a locking tab for each successive picket and associated insert, to lock all of the pickets in place. The punch may be struck by a hammer or the like or may be inserted into a press which forces the punch into the insert and then into the picket The rail 11 is then pushed downwardly (relative to FIG. 2*a*) or is pushed to the right relative to FIGS. 4*a*–4*c* to move from the position shown in FIG. 4*a* whereupon the hook tab 9 slides along the surface of insert 6 as shown in FIG. 4*b*, and eventually, the end of rail 11 rides up along the inclined surface of leg 8, as shown in FIG. 4*c*. Ultimately, hook rib 9 passes beyond the free end of leg 8 and snaps into position in the gap between legs 8 and 10, as shown in FIGS. 2*b*, 3 and 4*d*. It should be understood that rail 11 is moved substantially over its entire length so as to lock substantially simultaneously with the insert 5, i.e., so as to cause the hook rib 9 to become locked between legs 8 and 10. In this position, the rail 11 is locked into place and cooperates with the interlocked insert and pickets to provide a rigid fence structure. The rail and pickets are prevented from being easily removed providing security, as well as enhanced structural integrity.

In typical applications, two rails are provided each being near the upper and lower ends of the vertical row of pickets, as shown in FIG. 5. If desired, a greater or lesser number of rails and inserts may be employed. In any case, the rails and inserts provided at the lower end of the fence structure are mounted in a manner similar to that described hereinabove. However, it should be understood that the lower rail and insert should be mounted first, followed by the upper rail and insert.

As was mentioned hereinabove, the solid, bead-shaped rib 3 provides rigidity for the rail 11 along its length. Internal finger 2 engages the surfaces 4*c* of picket 5 opposite the surface 4*d* which engages the insert and prevents the rail from rotating over the top of the picket 5 in installations where the top ends of the pickets do not extend through openings in the yoke portion 13 of rail 11.

The legs 1 and 7 of rail 11, as shown best in FIGS. 4*a*–4*c* extend diagonally inwardly prior to being mounted upon a rail/picket assembly, but ultimately are pressed outwardly so as to be aligned parallel to one another to form a rectangular-shaped channel with yoke 13, after the insert is snapped into the rail, as shown in FIG. 4*d*. Rail 11 is provided with openings 12 in the yoke portion 13 thereof except in installations where the top ends of the pickets do not extend through the rail.

The punch P is preferably formed of a material having a capability of puncturing and then deforming the body portion of the insert and the pickets so that the inserts and pickets lock together. The punch does not require a mandrel on the interior side of the pickets in order to form the desired shape but a mandrel may be used, if desired, when punching near the ends of the pickets. The punch P causes one or more tabs (preferably two tabs) to be formed from the portion of the insert which is pierced which tabs protrude into the associated picket. The tabs prevent the associated picket from sliding vertically or horizontally relative to the insert independently of the rail. The rails further act to maintain the inserts and pickets in intimate engagement, adding to the structural integrity of the completed assembly.

The features of the assembled fence reside in the fact that, in addition to the elimination of conventional fasteners, or fastening means (i.e., tabs 4), there are no fasteners which are visible, since the tabs mentioned hereinabove, are completely covered by the rail. The assembled fence provides suitable supporting and locking strength and cannot be easily disassembled providing security and the pickets and rails provide an esthetically appealing outer appearance which is smooth and continuous and absent any distortion in surface members which is normally caused by conventional fasteners.

The fence of the present invention can be easily racked up to the sixty degrees (60°) arranged up or down grade, i.e., can be aligned so that the lower ends of the pickets, as well as the rails, lie along a line which is inclined by an angle of up to 60 degrees relative to the horizontal without concern of fasteners being loosened and without imposing any constraints on fence design.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. A fence comprising:

a plurality of pickets arranged in spaced parallel fashion;

an elongated insert engaging a surface portion of each picket and aligned transverse to a longitudinal axis of said pickets;

said insert having a pair of spaced apart locking ribs providing a gap therebetween;

a channel-shaped rail having a yoke portion and a pair of integral sidewalls extending from said yoke portion;

a free end of one of said sidewalls being provided with a hook rib;

said hook rib being snap-fitted in to said gap when said rail is moved along said pickets so that the sidewall having the hook rib is retained in said gap while the remaining sidewall engages a surface portion of the pickets opposite the surface portion engaging said insert to lock said rail relative to said insert; and said insert being locked to each picket by a tab pierced from a portion of the insert by a piercing tool which pierces the insert, cutting a tab therefrom and simultaneously driving the tab into the associated picket which is also pierced by the piercing tool.

2. The fence assembly of claim 1 wherein the sidewall of said rail opposite the sidewall engaging said insert is provided with an integral elongated reinforcing rib at the free end thereof.

3. The fence assembly of claim 1 wherein the sidewall of the rail opposite the sidewall engaging said insert is provided with an integral, elongated anti-rotation rib which engages a portion of the surface of each picket opposite the surface portion engaged by said insert to prevent the rail from rotating over the top of pickets which do not extend therethrough.

4. The fence assembly of claim 1 wherein a locking leg on said rail has a sloping surface to gradually guide the hook rib toward said gap as the hook rib slides along said sloping surface.

5. The fence assembly of claim 1 wherein said piercing tool has at least one sharp cutting edge and a diagonally aligned surface merging with the cutting edge at a free end thereof.

6. The fence assembly of claim 1 wherein said rail substantially covers and conceals said insert when said hook rib is snap-fittingly received in said gap to provide an aesthetically appealing appearance.

7. A method for forming a fence comprised of a plurality of pickets, at least one elongated, channel-shaped rail having an inwardly directed hook rib and at least one elongated insert having a pair of legs arranged in spaced apart fashion to provide a locking gap, said method comprising the steps of:

a) arranging the pickets in spaced parallel fashion;

b) positioning the insert so that its longitudinal axis is arranged transverse to said pickets and so that the insert engages a surface portion of each of said pickets;

c) piercing the insert at spaced intervals therealong which spaced intervals overly an associated picket, whereby the piercing action cuts through the insert at each piercing location forming at least one tab which is forced into the body of the associated picket which is also pierced by the piercing operation, so that the tab formed thereby locks each picket to the insert thereby preventing the pickets from moving longitudinally or latitudinally relative to the insert; and d) sliding the rail over ends of said pickets whereby the hook rib sliding engages said insert, said rail being moved over a distance sufficient to cause the hook rib to slide up along one of said locking legs and be snap-fitted into the gap region between said locking legs whereby the insert and rail become locked to one another.

8. A method for forming a fence comprised of a plurality of pickets, at least one elongated, channel-shaped rail having an inwardly directed hook rib and at least one elongated insert having a pair of legs arranged in spaced apart fashion to provide a locking gap, said method comprising the steps of:

a) forming openings in a yoke portion of said rail at spaced intervals therealong;

b) sliding each picket through an associated one of said openings;

c) arranging the pickets in spaced parallel fashion;

d) positioning the insert so that its longitudinal axis is arranged transverse to said pickets and so that the insert engages a surface portion of each of said pickets;

e) piercing the insert at spaced intervals therealong which spaced intervals overly an associated picket, whereby the piercing action cuts through the insert at each piercing location forming at least one tab which is forced into the body of the associated picket which is also pierced by the piercing operation, so that the tab formed thereby locks each picket to the insert thereby preventing the pickets from moving longitudinally or latitudinally relative to the insert; and f) sliding the rail over ends of said pickets whereby the hook rib sliding engages said insert, said rail being moved over a distance sufficient to cause the hook rib to slide up along one of said locking legs and be snap-fitted into the gap region between said locking legs whereby the insert and rail become locked to one another.

9.The method of claim 7 wherein step c) comprises employing a piercing tool having a tip shaped to respectively pierce the insert and the picket to form at least one tab from the pierced insert, which tab extends into the picket.

10. The method of claim 7 wherein step e) comprises employing a piercing tool having a tip shaped to respectively pierce the insert and the picket to form at least one tab from the pierced insert, which tab extends into the picket.

11. A fence comprising:

a plurality of pickets arranged in speed parallel fashion;

an elongated insert engaging a surface portion of each picket and aligned transverse to a longitudinal axis of said pickets;

said insert having a pair of spaced apart locking ribs providing a gap therebetween;

a channel-shaped rail having a yoke portion and a pair of integral sidewalls extending from said yoke portion;

said rail being positioned over said insert when said rail is moved along said pickets so that the sidewalls cover said insert;

said insert being locked to each picket by a tab pierced from a portion of the insert by a piecing troll which pierces the insert, cutting a tab therefrom and simultaneously driving the tab into the associated picket which is also pierced by the piercing tool; and wherein the pierce in said picket conforms to a shape of the pierced tab and intimately engages a pierced portion of the tab extending into said picket to prevent rattling between said insert and said picket.

12. A fence which can be easily racked to 60 degrees (60°) up or down grade without concern of loosening fasteners or design constraints, compromising:

a plurality of pickets arranged in spaced parallel fashion;

an elongated insert engaging a surface portion of each picket and aligned transverse to a longitudinal axis of said pickets;

said insert having a pair of spaced apart locking ribs providing a gap therebetween;

a channel-shaped rail having a yoke portion and a pair of integral sidewalls extending from said yoke portion;

a free end of one of said sidewalls being provided with a hook rib;

said hook rib being snap-fitted in to said gap when said rail is moved along said pickets so that the sidewall having the hook rib engages said gap while the remaining sidewall engages a surface portion of the pickets opposite the surface portion engaging said insert to lock said rail relative to said insert; and said insert being locked to each picket by a tab pierced from a portion of the insert by a piercing tool which pierces the insert, cutting a tab therefrom and simultaneously driving the tab into the associated picket which is also pierced by the piercing tool.

13. A fence comprising:

plurality of pickets arranged in spaced parallel fashion;

an elongated insert engaging a surface portion of each picket and aligned transverse to a longitudinal axis of said pickets;

the insert being locked to each picket by a table pierced from a portion of the insert by a piercing tool which pierces the insert, cutting a tab therefrom and simultaneously driving the table into the associated picket which is also pierced by the piercing tool; and wherein the pierce in said picket conforms to a shape of the pierced tab and intimately engages a pierced portion of the tab extending into said picket to prevent rattling between said insert and said picket.

14. A fence according to claim 1 wherein the pierce in said picket conforms to a shape of the pierced tab and intimately engages a pierced portion of the tab extending into said picket.

* * * * *